US012546086B2

(12) United States Patent
Kim et al.

(10) Patent No.: US 12,546,086 B2
(45) Date of Patent: Feb. 10, 2026

(54) CONSTRUCTION EQUIPMENT

(71) Applicant: VOLVO CONSTRUCTION EQUIPMENT AB, Eskilstuna (SE)

(72) Inventors: Younghun Kim, Gimhae-si (KR); Yoonjung Gil, Daegu (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 280 days.

(21) Appl. No.: 18/123,409

(22) Filed: Mar. 20, 2023

(65) Prior Publication Data

US 2023/0323626 A1 Oct. 12, 2023

(30) Foreign Application Priority Data

Apr. 11, 2022 (KR) ..... 10-2022-0044485

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/2004* (2013.01);
(Continued)

(58) Field of Classification Search
CPC . E02F 3/435; E02F 3/32; E02F 9/2004; E02F 9/2228; E02F 9/262; E02F 9/265;
(Continued)

(56) References Cited

U.S. PATENT DOCUMENTS 5,752,333 A 5/1998 Nakagawa et al.
5,835,874 A 11/1998 Hirata et al.
(Continued)

FOREIGN PATENT DOCUMENTS

JP H07-094735 B 10/1995
KR 10-1737389 B 5/2017
KR 10-1910523 B 5/2017

OTHER PUBLICATIONS

Extended European Search Report, European Application No. 23160890.2, mailed Aug. 21, 2023, 8 pages.

*Primary Examiner* — Anne Marie Antonucci
*Assistant Examiner* — Patrick Daniel Mohl
(74) *Attorney, Agent, or Firm* — Sage Patent Group

(57) ABSTRACT

The construction equipment includes a lower traveling part, an upper turning part, a work device, a control valve configured to control the hydraulic cylinder, and an operation lever. The construction equipment further includes a work setting unit configured to set a work area of the work device and an information providing unit configured to provide at least one of geographic information, position information of the work device, and posture information of the work device. The construction equipment also includes an electronic control unit configured to output a control signal for the control valve according to a signal input from at least one of the operation lever, the work setting unit, and the information providing unit. In the event the work device is likely to invade the work area, the electronic control unit determines cutoff strength for the operation signal based on a velocity of the work device.

8 Claims, 7 Drawing Sheets

(51) Int. Cl.
*E02F 9/20* (2006.01)
*E02F 9/22* (2006.01)
*E02F 9/26* (2006.01)

(52) U.S. Cl.
CPC ..... *E02F 9/2228* (2013.01); *E02F 9/262* (2013.01); *E02F 9/265* (2013.01)

(58) Field of Classification Search
CPC ..... E02F 3/437; E02F 9/2033; E02F 9/2025; E02F 9/2029; E02F 9/245; E02F 9/24; E02F 9/2221; E02F 9/2264; B60Y 2200/412
See application file for complete search history.

(56) References Cited

U.S. PATENT DOCUMENTS

| | | | | |
|---|---|---|---|---|
| 2017/0284070 | A1* | 10/2017 | Matsuyama | E02F 9/20 |
| 2020/0032482 | A1* | 1/2020 | Meguriya | E02F 9/2033 |
| 2020/0181883 | A1 | 6/2020 | Igarashi et al. | |
| 2020/0224383 | A1* | 7/2020 | Ishida | E02F 3/435 |
| 2021/0062460 | A1* | 3/2021 | Chiba | E02F 9/2271 |
| 2021/0079625 | A1* | 3/2021 | Narikawa | E02F 3/435 |
| 2021/0222397 | A1* | 7/2021 | Sharma | E02F 9/265 |
| 2022/0145580 | A1* | 5/2022 | Igarashi | E02F 9/2029 |
| 2022/0186459 | A1* | 6/2022 | Igarashi | E02F 9/265 |

* cited by examiner (a)

(b)

CONSTRUCTION EQUIPMENT

CROSS-REFERENCE TO RELATED APPLICATION

This application claims priority to and the benefit of Korean Patent Application No. 10-2022-0044485, filed on Apr. 11, 2022, the disclosure of which is incorporated herein by reference in its entirety.

TECHNICAL FIELD

The disclosure relates generally to construction equipment. In particular aspects, the disclosure relates to construction equipment having a work area limiting function. The disclosure can be applied to heavy-duty vehicles, such as trucks, buses, and construction equipment, among other vehicle types. Although the disclosure may be described with respect to a particular vehicle, the disclosure is not restricted to any particular vehicle.

BACKGROUND

In general, excavators are construction equipment which performs various types of work in a construction side or the like, such as excavation work of digging in the ground, loading work of transporting earth and sand, crushing work of dismantling a building, tillage work of organizing a ground surface, and leveling work of leveling a ground surface.

Referring to FIG. 1, construction equipment 1 such as an excavator includes a lower traveling part 2, an upper turning part 3 rotatably installed on the lower traveling part 2, and a work device 4 installed to vertically operate on the upper turning part 3.

In addition, the work device 4 is formed to have a multi-joint and includes a boom 4*a* of which a rear end portion is rotatably supported on the upper turning part 3, an arm 4*b* of which a rear end portion is rotatably supported on a front end portion of the boom 4*a*, and a bucket 4*c* rotatably installed at a front end portion of the arm 4*b*. According to a lever operation of a user, hydraulic oil is supplied, and a boom cylinder 5 (work actuator), an arm cylinder 6 (work actuator), and a bucket cylinder 7 (work actuator) operate the boom 4*a*, the arm 4*b*, and the bucket 4*c*, respectively.

In the construction equipment 1, the work device 4 such as the boom 4*a*, the arm 4*b*, or the bucket 4*c* is operated through manual operation levers, but since each component of the work device 4 is connected through a joint to perform a rotational motion, in order to operate each component of the work device 4 to work in a certain area, a driver's considerable effort is required.

Therefore, in order to facilitate such work, a work area control device for an excavator is disclosed in Japanese Patent Registration Hei 7-94735. The work area control device controls movement of the bucket 4*c* according to a distance between an end of the bucket 4*c* and a boundary line of an invasion prohibited area. Therefore, even if a driver tries to move the end of the bucket 4*c* to the invasion prohibited area by mistake, the bucket 4*c* is automatically stopped on the boundary line of the invasion prohibited area. In addition, the driver may return the end of the bucket 4*c* by perceiving that the work device 4 is approaching the invasion prohibited area from the fact that the velocity of the work device 4 is decreasing during work.

FIG. 2 illustrates a situation in which the velocity of one point P1 or P2 of the work device 4 is limited only by a distance between one point P1 or P2 of the work device 4 and a work area W. For example, one point P1 or P2 of the work device 4 may be an end of the bucket.

Specifically, according to the related art, when a distance d1 between an end P1 of the bucket and the work area W is less than or equal to dmin, which is a criterion for limiting velocity, the velocity of the bucket starts to be limited.

However, according to the related art, even when there is no possibility of invading the work area W because an end P2 of the bucket moves to be parallel to the work area W, since a distance d2 between the end P2 of the bucket and the work area W is less than or equal to dmin, the velocity of the bucket is limited.

That is, according to the related art, since it is based on a distance between the work device 4 and the work area W, even when there is no possibility of invading the work area W, the velocity of the work device 4 is limited, and thus there is a problem that work velocity and efficiency drop during excavation work.

FIG. 3 illustrates a situation in which points P1 and P2 of the work device 4 approach to a work area W at different approach velocities. For example, one point P1 or P2 of the work device 4 may be an end of the bucket.

In this regard, since a braking time is proportional to velocity, in a case in which the velocity of the work device is high, only when the velocity of the work device should be more rapidly limited, the work device does not invade the work area W. For example, since the end P2 of the bucket approaches the work area W faster than the end P of the bucket, the velocity of the end P2 of the bucket should be limited more rapidly than the velocity of the end P1 of the bucket.

However, according to the related art, since the distances between the ends P1 and P2 of the bucket and the work area W are the same as dmin, the velocity of the bucket is also limited in the same way.

That is, according to the related art, since velocity is uniformly limited based on the distance between the work device 4 and the work area W without consideration of the approach velocity of the work device 4, when the approach velocity of the work device 4 is high, there is a problem in that the work device 4 may invade the work area W.

SUMMARY

According to a first aspect of the present invention, there is provided construction equipment including a lower traveling part, an upper turning part rotatably supported on the lower traveling part, a work device which includes a boom, an arm, and a bucket operated by respective hydraulic cylinders and is supported on the upper turning part, a control valve configured to control the hydraulic cylinder, an operation lever configured to output an operation signal corresponding to an operation amount of a driver, a work setting unit configured to set a work area of the work device, an information providing unit configured to provide at least one of geographic information, position information of the work device, and posture information of the work device, and an electronic control unit configured to output a control signal for the control valve according to a signal input from at least one of the operation lever, the work setting unit, and the information providing unit, wherein, when the work device is likely to invade the work area, the electronic control unit determines cutoff strength for the operation signal based on a velocity of the work device. The first aspect of the disclosure may seek to solve a problem in that the work device may invade the work area when an approach velocity is fast. A technical benefit may include a technical effect in which, even when the work device is positioned close to the work area, when the work device is not likely to invade the work area, a velocity of the work device is not limited, and thus a worker's work connection becomes natural. In addition, a technical benefit may include a technical effect in which, since cutoff strength for an operation lever signal is determined according to an expected collision time of the work device, even when an approach velocity of the work device is fast, the work device does not invade the work area, and a worker can more stably operate the work device.

In some examples, including in at least one preferred example, optionally, the electronic control unit may calculate an expected collision distance ($d_{go}$) between one point of the work device and an expected collision point of the work area to determine whether the work device is likely to invade the work area.

In some examples, including in at least one preferred example, optionally, when the expected collision distance ($d_{go}$) is finite, the electronic control unit may determine that the work device is likely to invade the work area, and when the expected collision distance ($d_{go}$) is infinite, the electronic control unit may determine that the work device is not likely to invade the work area.

In some examples, including in at least one preferred example, optionally, when the expected collision distance ($d_{go}$) is finite, the electronic control unit may calculate an expected collision time ($t_{go}$) by dividing the expected collision distance ($d_{go}$) by a velocity of the one point of the work device.

In some examples, including in at least one preferred example, optionally, the electronic control unit may determine the cutoff strength for the operation signal based on the expected collision time ($t_{go}$) and a preset table.

In some examples, including in at least one preferred example, optionally, in the table, when the expected collision time ($t_{go}$) is greater than or equal to a certain time, the cutoff strength for the operation signal may be 0%, when the expected collision time ($t_{go}$) is greater than or equal to 0 and less than or equal to the certain time, the cutoff strength for the operation signal may increase as the expected collision time ($t_{go}$) decreases, and when the expected collision time ($t_{go}$) is 0, the cutoff strength for the operation signal may be 100%.

In some examples, including in at least one preferred example, optionally, the work setting unit may include a display device configured to display an adjustment portion, and the electronic control unit may include a plurality of tables having different cutoff strengths for the operation signal and may determine a standard table by adjusting the adjustment portion.

In some examples, including in at least one preferred example, optionally, the electronic control unit may calculate the expected collision time ($t_{go}$) for each of a plurality of points of the work device and may determine the cutoff strength for the operation signal based on a minimum value of the expected collision times ($t_{go}$) and the preset table.

In some examples, including in at least one preferred example, optionally, the information providing unit may include at least one of a position measurement unit configured to measure position information of the construction equipment, a posture measurement unit configured to measure posture information of the construction equipment and a posture of each work device, and a coordinate calculation unit configured to calculate coordinates based on information measured from the position measurement unit and the posture measurement unit.

In some examples, including in at least one preferred example, optionally, the operation lever may be an electric joystick configured to generate an electrical signal in proportion to the operation amount of the driver and provide the electrical signal to the electronic control unit.

In some examples, including in at least one preferred example, optionally, the work setting unit may have a function of setting a plurality of work modes according to needs of the driver and according to a setting of the work mode, may display at least one of the geographic information, the position information of the work device, and the posture information of the work device, which are received from the information providing unit, on a display screen.

The disclosed aspects, examples (including any preferred examples), and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

BRIEF DESCRIPTION OF THE DRAWINGS

Examples are described in more detail below with reference to the appended drawings.

DETAILED DESCRIPTION

The detailed description set forth below provides information and examples of the disclosed technology with sufficient detail to enable those skilled in the art to practice the disclosure.

Figure 1:
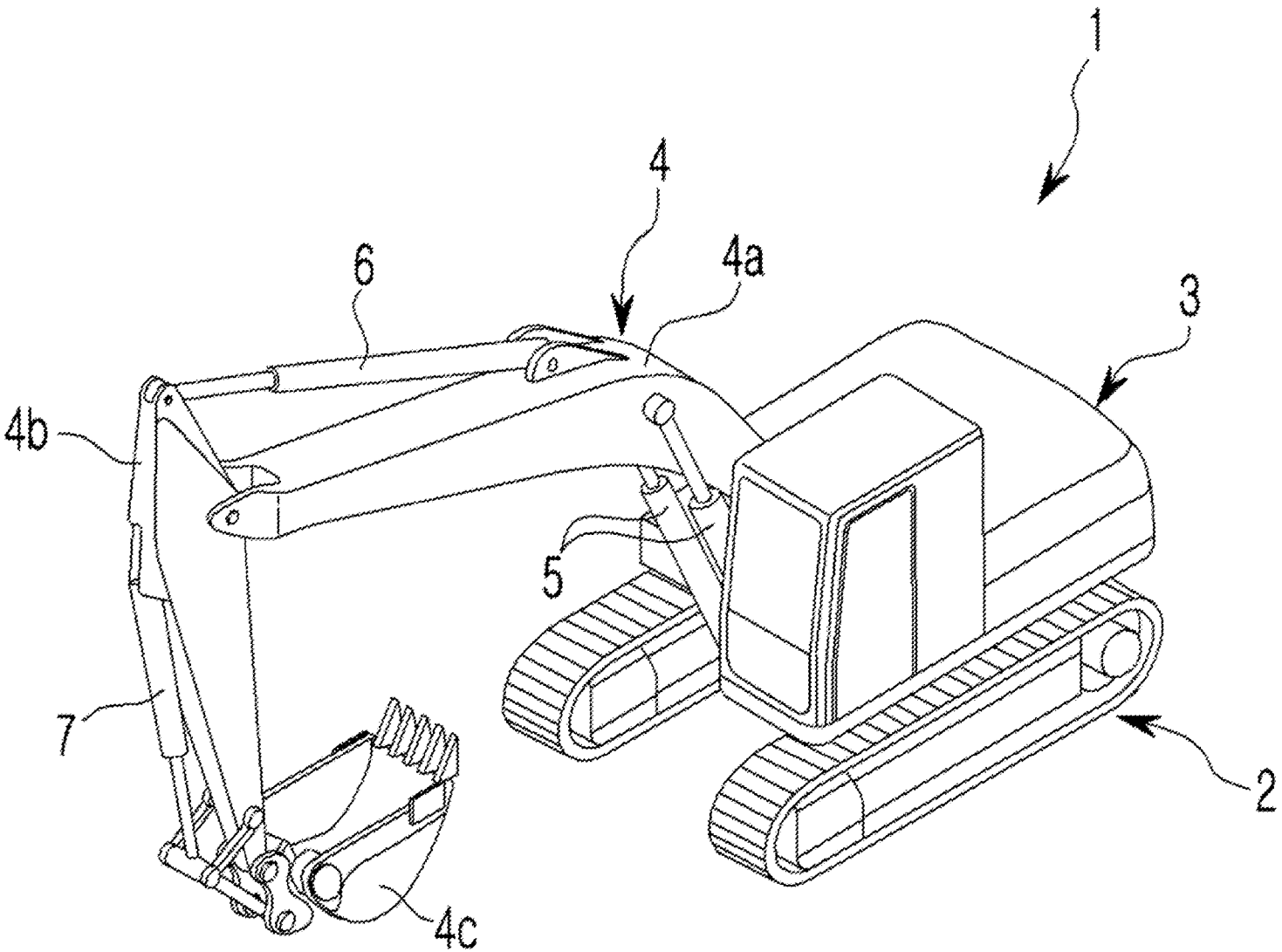
FIG. 1 is a perspective view illustrating a basic configuration of construction equipment.
Figure 2:
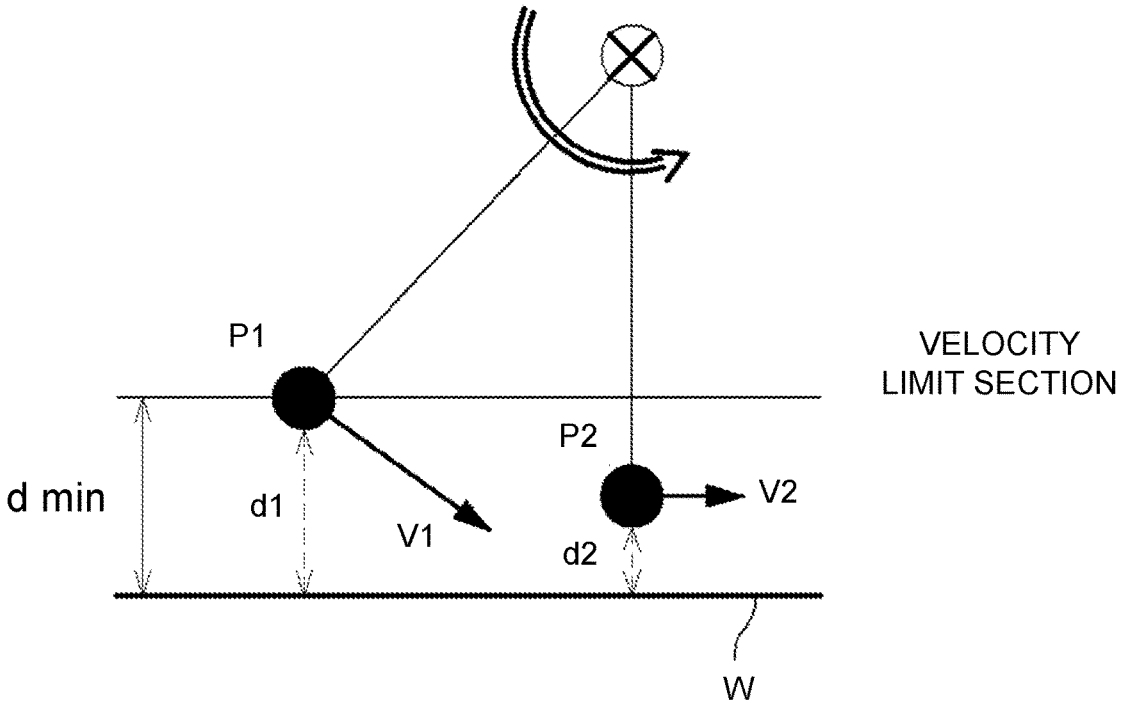
FIGS. 2 and 3 are schematic diagrams illustrating a velocity control method of a work device according to the related art.
Figure 3:
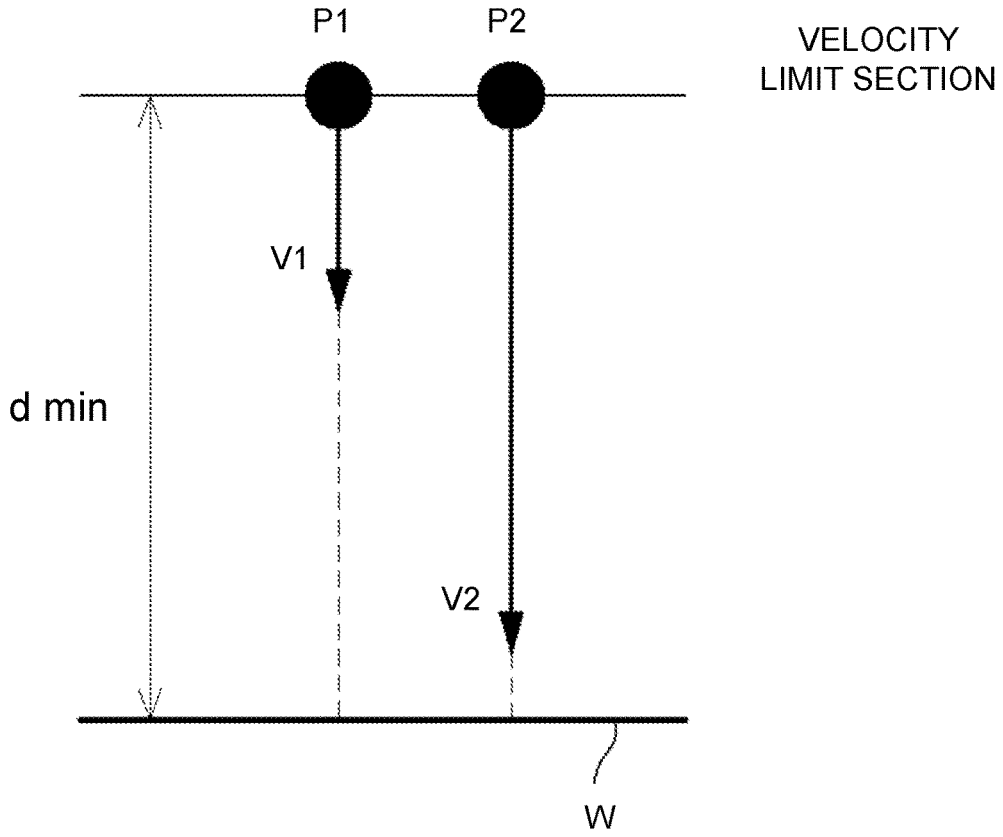
Figure 4:
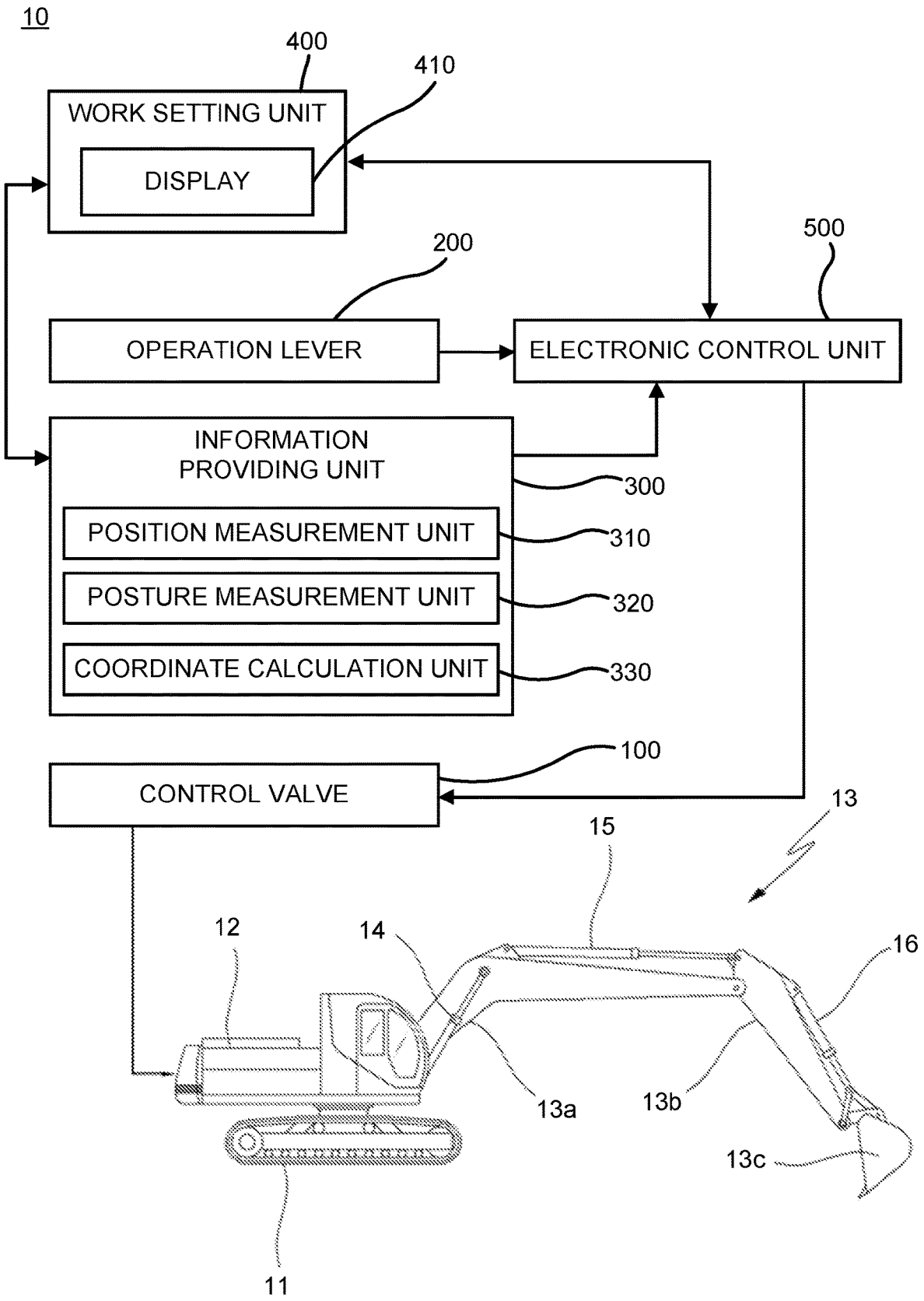
FIG. 4 is a schematic diagram of a work area limiting function of construction equipment according to one aspect of the disclosure.

Referring to FIG. 4, construction equipment 10 having a work area limiting function according to one aspect of the disclosure includes a lower traveling part 11, an upper turning part 12 rotatably supported on the lower traveling part 11, a work device 13 which includes a boom 13*a*, an arm 13*b*, and a bucket 13*c* operated by respective hydraulic cylinders and is supported on the upper turning part 12, a control valve 100 configured to control the hydraulic cylinders, an operation lever 200 configured to output an operation signal corresponding to an operation amount of a driver, an information providing unit 300 configured to collect and/or calculate geographic information, position information and posture information of the work device 13, and/or position information of a work area W, a work setting unit 400 capable of setting and/or selecting the work area W of the work device 13, and an electronic control unit 500 configured to output a control signal for the control valve 100 according to a signal input from at least one of the work setting unit 400 and the information providing unit 300.

The control valve 100 is a member which opens or closes a flow path through a spool that receives pressure to move in an axial direction. That is, the control valve 100 serves to change a supply direction of hydraulic oil supplied by a hydraulic pump, which is a hydraulic source, toward the hydraulic cylinder. The control valve 100 is connected to the hydraulic pump through a hydraulic pipe and guides hydraulic oil to be supplied from the hydraulic pump to the hydraulic cylinder.

The operation lever 200 may be a hydraulic joystick or an electric joystick and may preferably be the electric joystick which generates an electrical signal in proportion to an operation amount of a driver and provides the electrical signal to the electronic control unit 500.

The information providing unit 300 may include at least one of a position measurement unit which receives signals transmitted from global positioning system (GPS) satellites and measures position information of the construction equipment 10, a posture measurement unit which measures posture information of the construction equipment 10 and a posture of at least one of the boom 13*a*, the arm 13*b*, and the bucket 13*c*, and a coordinate calculation unit which calculates coordinates of the construction equipment 10 based on information measured from the position measurement unit and the posture measurement unit.

The position measurement unit 310 may include a receiver capable of receiving signals transmitted by the GPS satellites and may measure position information of the construction equipment 10, position information of the work area W, and/or geographic information around a work position from the received signals.

By using a plurality of inertial multiple measurement units (IMUs), angle sensors, or the like, the posture measurement unit 320 measures a position and/or a posture of at least one of the boom 13*a*, the arm 13*b*, and the bucket 13*c*, a velocity, and an inclination of a main part of the construction equipment 10.

The coordinate calculation unit 330 calculates coordinates (x, y, z) of at least one of the boom 13*a*, the arm 13*b*, and the bucket 13*c* using position information and posture information measured by the position measurement unit 310 and the posture measurement unit 320.

In addition, the information providing unit 300 may further include a mapping unit which maps geographic information around a work position and construction information about the work position to calculated coordinates. The mapping unit adjusts and maps a position and/or posture of each work device 13 and an inclination of the main part of the construction equipment 10, which are measured by the posture measurement unit, according to each axis calculated by the coordinate calculation unit.

The work setting unit 400 may set and/or select the work area W of the work device 13 and may provide plane information of the set and/or selected work area W to the electronic control unit 500. In addition, the work setting unit 400 may have a work mode function capable of variously setting and selecting a bucket posture control mode, a work area limit mode, and a swing position control mode according to needs of a driver.

According to the setting and/or selecting of the work area W and/or a work mode, the work setting unit 400 displays at least one of geographic information, position information and posture information of the construction equipment 10 received from the information providing unit 300 and plane information of the work area W set by the work setting unit 400 on a display device, for example, a screen of a display 410.

That is, a driver may set and/or select the work area W and/or the work mode on the screen of the display 410 and thus may easily work using displayed information. In this case, the work area W is a design surface that is a work target of a driver.

Preferably, the work setting unit 400 displays an adjustment portion 412, which is laterally operable by a worker, on the screen of the display 410, and provides operation information about the adjustment portion 412 to the electronic control unit 500.

When an operation signal of the operation lever 200 is input, based on geographic information, and position information and posture information of the construction equipment 10 received from the information providing unit 300 and plane information of the work area W set by the work setting unit 400, the electronic control unit 500 calculates an expected collision distance $d_{go}$ between the work device 13 and the work area W to determine whether there the work device 13 is likely to invade the set work area W. When the work device 13 is likely to invade the set work area W, the electronic control unit 500 calculates an expected collision time $t_{go}$ of the work device 13. Next, the electronic control unit 500 compares the calculated expected collision time $t_{go}$ with a table stored in the electronic control unit 500 to determine cutoff strength for an operation signal of the operation lever 200. Based on the cutoff strength for the operation signal of the operation lever 200, a control signal is output to the control valve 100 which controls the hydraulic cylinder.

That is, when the work area limiting function according to the disclosure is activated, an operation signal of the operation lever 200, various types of information of the information providing unit 300, and plane information of the work area W set by the work setting unit 400 are input to the electronic control unit 500. The electronic control unit 500 determines cutoff strength for the operation signal of the operation lever 200 based on collected information and thus controls movement of the work device 13.

Hereinafter, an operation method of construction equipment having a work area limiting function according to one aspect of the disclosure will be described in detail.

First, a driver selects an active control mode on a work setting unit 400 and sets a target work area W, and plane information of the work area W is provided to an electronic control unit 500. In addition, an information providing unit 300 collects and/or calculates geographic information, position information, and posture information of construction equipment 10 and provides the geographic information, the position information, and the posture information to an electronic control unit 500. Then, the driver operates an operation lever 200 of a boom 13*a*, an arm 13*b*, or a bucket 13*c* for work.

Based on received position information and posture information of a work device 13 and position information of the set work area W, the electronic control unit 500 calculates an expected collision distance $d_{go}$ and determines whether the work device 13 is likely to invade the set work area W.

Figure 5:
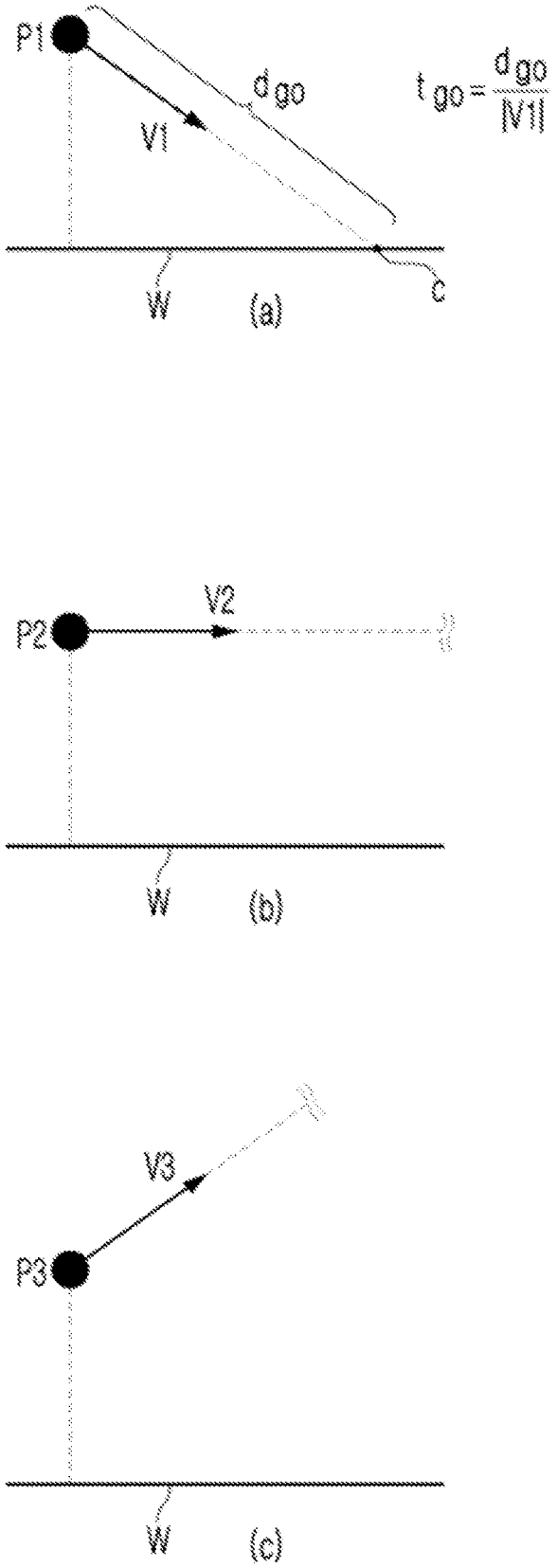
FIG. 5 shows schematic diagrams illustrating a method of calculating an expected collision distance and an expected collision time of one point of construction equipment according to one aspect of the disclosure.

Specifically, FIG. 5 shows schematic diagrams illustrating a method of calculating an expected collision distance and an expected collision time of one point of construction equipment according to one aspect of the disclosure. Here, one point P1, P2, or P3 of a work device 13 may be one point of a boom 13*a*, an arm 13*b*, and a bucket 13*c*.

First, as shown in FIG. 5A, when one point P1 of the work device 13 approaches a work area W at a velocity V1, an intersection between the work area W and an extension line extending in a direction of the velocity vector V1 becomes an expected collision point c of one point P1 of the work device 13.

An electronic control unit 500 calculates an expected collision distance $d_{go}$ from coordinates of one point P1 of the work device 13 and the expected collision point c. Since the expected collision distance $d_{go}$ is calculated to be finite, the electronic control unit 500 determines that the point P1 of the work device 13 is likely to invade the set work area W.

On the other hand, as shown in FIG. 5B, when one point P2 of the work device 13 moves to be parallel to the work area W, the expected collision distance $d_{go}$ is calculated to be infinite. Therefore, the electronic control unit 500 determines that the one point P2 of the work device 13 is not likely to invade the set work area W.

In addition, as shown in FIG. 5C, when one point P3 of the work device 13 moves to be parallel to a side opposite to the work area W, the expected collision distance $d_{go}$ is calculated to be infinite. Therefore, the electronic control unit 500 determines that the one point P3 of the work device 13 is not likely to invade the set work area W.

That is, when the expected collision distance $d_{go}$ is calculated to be finite, the electronic control unit 500 determines that the work device 13 is likely to invade the set work area W, and when the expected collision distance $d_{go}$ is calculated to be infinite, the electronic control unit 500 determines that the work device 13 is not likely to invade the set work area W.

However, the disclosure is not limited thereto, and when a velocity vector of one point of the work device 13 is directed toward the work area W, it may be determined that the work device 13 is likely to invade the set work area W.

When it is determined that the work device 13 is likely to invade the set work area W, the electronic control unit 500 calculates an expected collision time $t_{go}$ of the work device 13.

Specifically, as shown in FIG. 5A, the electronic control unit 500 calculates the expected collision time $t_{go}$ by dividing the expected collision distance $d_{go}$ by a magnitude of the velocity vector V1 at one point P1 of the work device 13. That is, $$t_{go} = d_{go}/|V1|.$$

When the expected collision time $t_{go}$ of the work device 13 is calculated, the electronic control unit 500 compares the calculated expected collision time $t_{go}$ with a preset table to determine cutoff strength for an operation signal of an operation lever 200.

Figure 6:
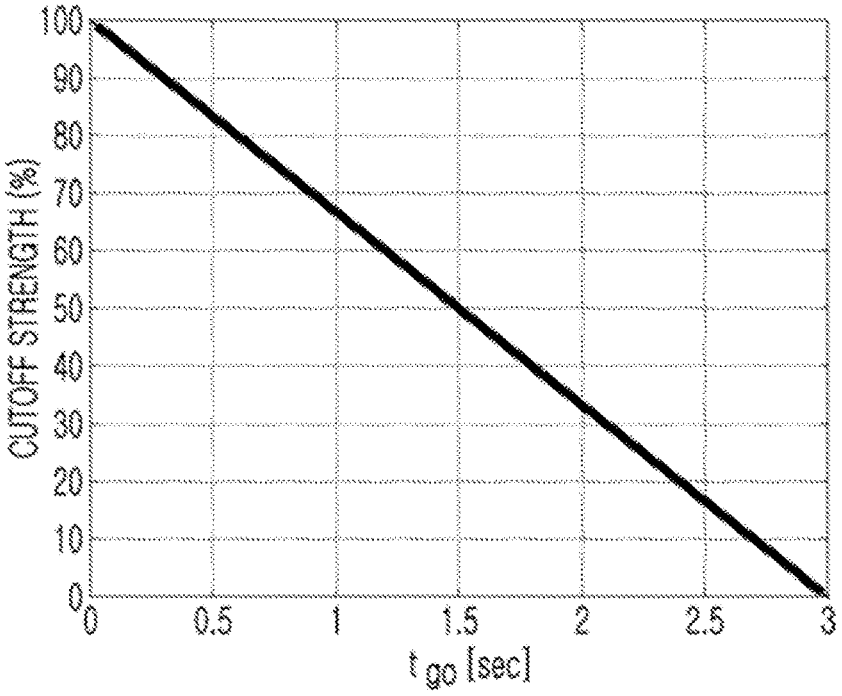
FIG. 6 shows graphs showing cutoff strength according to an expected collision time of construction equipment according to one aspect of the present disclosure.
Figure 6:
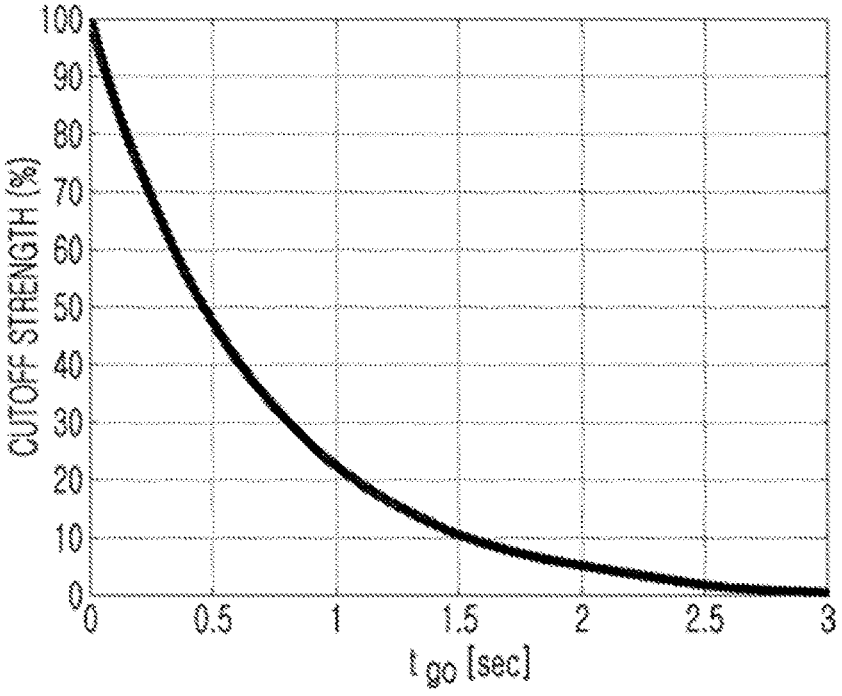

FIG. 6 shows graphs showing a table according to one aspect of the disclosure. Here, a horizontal axis represents the expected collision time $t_{go}$, and a vertical axis represents the cutoff strength for the operation signal of the operation lever 200.

For example, as shown in FIG. 6A, the table may be configured such that the cutoff strength for the operation signal of the operation lever 200 linearly increases as the expected collision time $t_{go}$ decreases.

Specifically, when the expected collision time $t_{go}$ is greater than or equal to 3 seconds, the cutoff strength for the operation signal of the operation lever 200 is 0%, and the work device 13 moves in proportion to an operation amount of a driver with respect to the operation lever 200. When the expected collision time $t_{go}$ is greater than or equal to 0 seconds and less than or equal to 3 seconds, as the expected collision time $t_{go}$ decreases, the cutoff strength for the operation signal of the operation lever 200 increases linearly, and the work device 13 moves as much as less than an operation amount of a driver with respect to the operation lever 200. When the expected collision time $t_{go}$ is 0 seconds, the cutoff strength for the operation signal of the operation lever 200 is 100%, and movement of the work device 13 is restricted despite a driver's operation of the operation lever 200.

In addition, as shown in FIG. 6B, the table may be configured such that the cutoff strength for the operation signal of the operation lever 200 increases exponentially as the expected collision time $t_{go}$ decreases.

Specifically, the table of FIG. 6B has a form in which the cutoff strength slowly increases when the expected collision time $t_{go}$ approaches a certain time, and the cutoff strength rapidly increases at a time point at which a collision is imminent.

Here, since the cutoff strength of the table in FIG. 6A is greater than the cutoff strength of the table in FIG. 6B, it may be regarded that a cutoff strength level of the table in FIG. 6A is higher than a cutoff strength level of the table in FIG. 6B.

Figure 7:
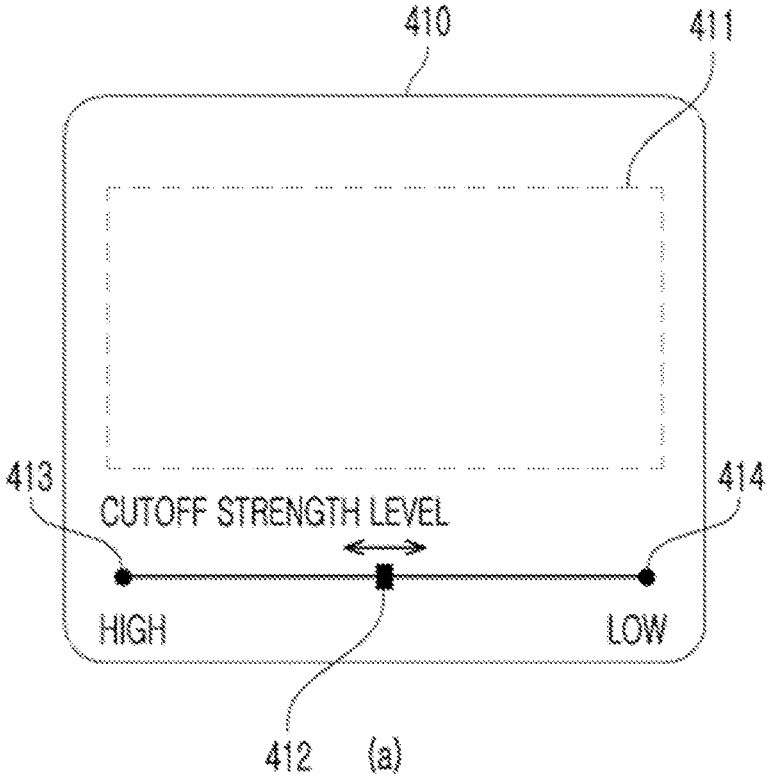
FIG. 7 illustrates a method of adjusting a cutoff strength level through a display according to one aspect of the disclosure.
Figure 7:
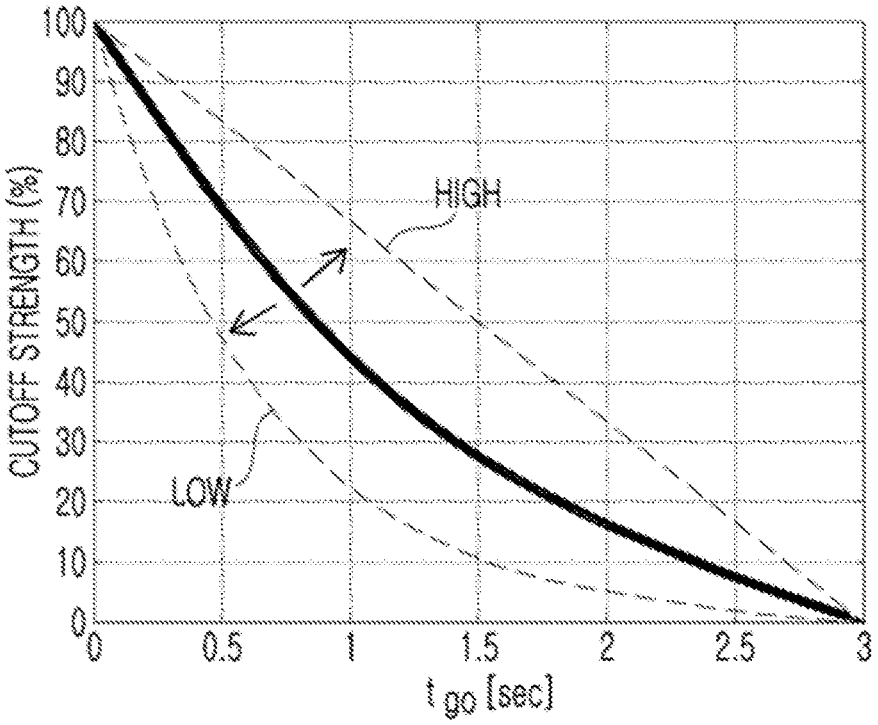

FIG. 7 illustrates a method of adjusting a cutoff strength level through a display 410 according to one aspect of the disclosure. As shown in FIG. 7A, in one area 411 of the display 410, for example, geographic information, position information, and posture information of construction equipment 10 received from an information providing unit 300 and plane information of a work area W set by a work setting unit 400 may be displayed.

Preferably, an electronic control unit 500 may include a plurality of tables having different cutoff strength levels, and a worker may adjust the cutoff strength level through the display 410.

An adjustment portion 412 displayed on the display 410 is for adjusting a cutoff strength level and is provided to, for example, laterally slide.

Adjustment information of the adjustment portion 412 is provided to the electronic control unit 500, and the electronic control unit 500 determines a cutoff strength level based on the adjustment information.

For example, when the adjustment portion 412 is positioned at a left end 413, a cutoff strength level is set to the highest, and cutoff strength is determined according to a table HIGH. In this case, even in a situation in which topography is unstable or a large load is applied to a bucket, a worker can more stably operate a work device 13.

A cutoff strength level is set to be lowered as the adjustment portion 412 moves to the right, and cutoff strength is determined along a table (solid line).

When the adjustment portion 412 is positioned at a right end 414, a cutoff strength level is set to the lowest, and cutoff strength is determined along a table LOW. In a situation in which there is no risk of equipment shaking because topography is stable or there is no instability of the equipment because a small load is applied to the bucket, a worker may more flexibly operate the work device 13.

That is, the worker may determine a standard table by sliding the adjustment portion 412 displayed on the display 410 according to a situation.

Preferably, the electronic control unit 500 may calculate a plurality of expected collision times $t_{go}$ for a plurality of points of the work device 13 and may compare a minimum value of the plurality of expected collision times $t_{go}$ with a preset reference value to determine cutoff strength for an operation signal of an operation lever 200.

Hereinafter, a method of calculating expected collision times $t_{go}$ based on a plurality of points of a work device 13 will be described in detail.

Figure 8:
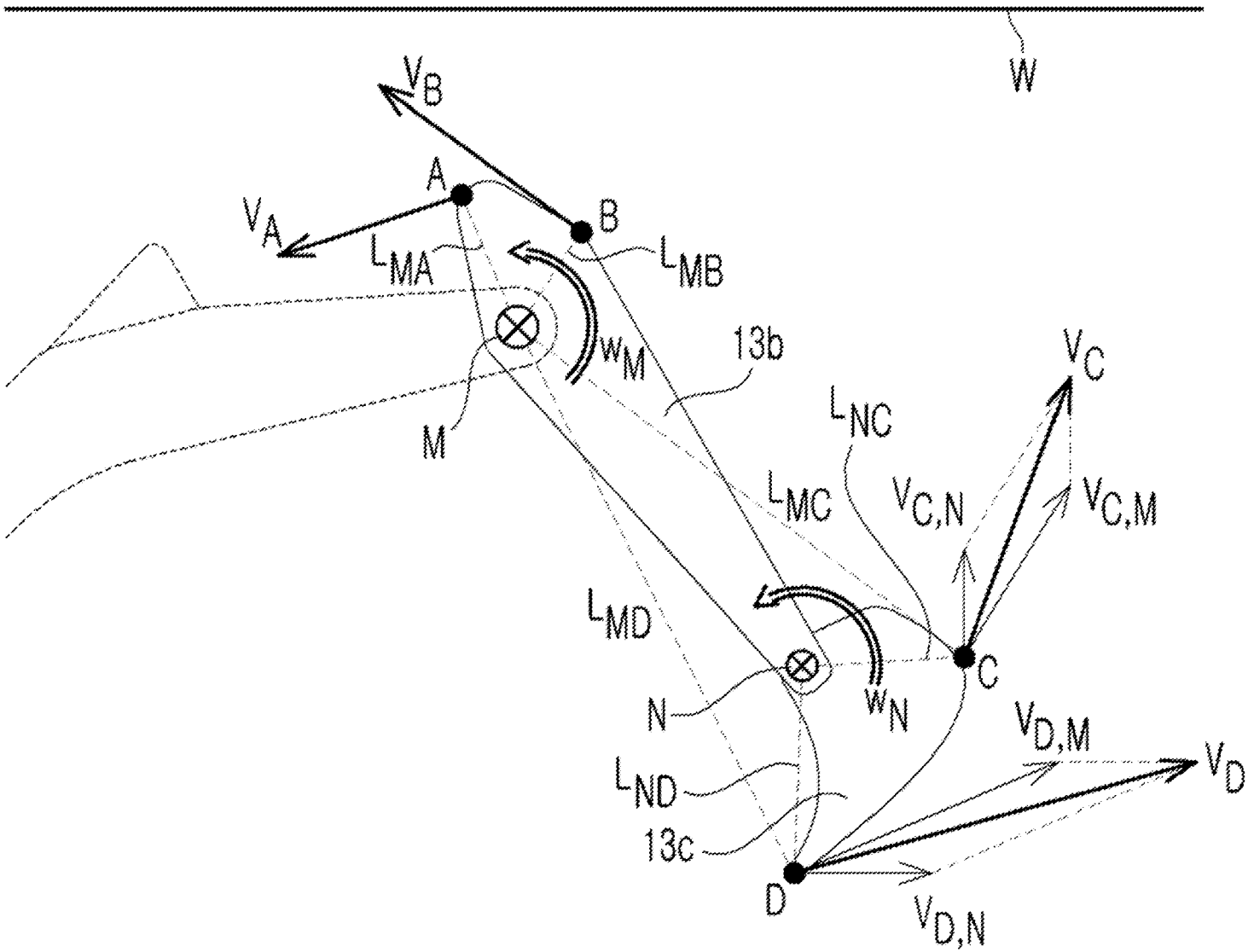
FIG. 8 shows schematic diagrams illustrating a method of calculating expected collision times based on a plurality of points of construction equipment according to one aspect of the disclosure.

FIG. 8 is a diagram illustrating a situation in which a work area W is positioned above a work device 13, an arm 13*b* and a bucket 13*c* rotate counterclockwise at an angular velocity $w_1$ with respect to an arm pin M, and the bucket 13*c* rotates counterclockwise at an angular velocity $w_2$ with respect to a bucket pin N.

As shown in FIG. 8, an electronic control unit 500 may calculate expected collision times $t_{go}$ based on points A and B of the arm 13*b* and points C and D of the bucket 13*c*. However, a measurement point of the work device 13 is not limited thereto.

First, the electronic control unit 500 determines whether each point is likely to invade the work area W. Specifically, since the point A of the arm 13*b* rotates counterclockwise at an angular velocity $w_M$ around the arm pin M, when a linear velocity at the point A of the arm 13*b* is $\vec{v}_A$, $\vec{v}_A=\vec{w}_M\times\vec{L}_{MA}$. Here, since the point A of the arm 13*b* moves to a side opposite to the work area W, an expected collision distance $d_{go,A}$ is calculated to be infinite, and the electronic control unit 500 determines that the point A of the arm 13*b* is not likely to invade the set work area W.

Since the point B of the arm 13*b* rotates counterclockwise at the angular velocity $w_M$ around the arm pin M, when a linear velocity at the point B of the arm 13*b* is $\vec{v}_B$, $\vec{v}_B=\vec{w}_M\times\vec{L}_{MB}$. Here, since the point B of the arm 13*b* moves toward the work area W, an expected collision distance $d_{go,B}$ to be calculated to be finite, and the electronic control unit 500 determines that the point B of the arm 13*b* is likely to invade the set work area W.

Since the point C of the bucket 13*c* rotates counterclockwise at the angular velocity $w_M$ around the arm pin M, when a linear velocity at the point C of the bucket 13*c* relative to the arm pin M is $\vec{v}_{C,M}$, $\vec{v}_{C,M}=\vec{w}_M\times\vec{L}_{MC}$. In addition, since the point C of the bucket 13*c* rotates counterclockwise at an angular velocity $w_N$ around the bucket pin N, when a linear velocity at point C of the bucket 13*c* relative to the bucket pin N is $\vec{v}_{C,N}$, $\vec{v}_{C,N}=\vec{w}_N\times\vec{L}_{NC}$. Therefore, when a linear velocity at the point C of the bucket 13*c* is $\vec{v}_C$, $\vec{v}_C=\vec{v}_{C,M}+\vec{v}_{C,N}$.

Here, since the point C of the bucket 13*c* moves toward the work area W, an expected collision distance $d_{go,C}$ is calculated to be finite, the electronic control unit 500 determines that the point C of the bucket 13*c* is likely to invade the set work area W.

Since the point D of the bucket 13*c* rotates counterclockwise at the angular velocity $w_M$ around the arm pin M, when a linear velocity at the point D of the bucket 13*c* relative to the arm pin M is $\vec{v}_{D,M}$, $\vec{v}_{D,M}=\vec{w}_M\times\vec{L}_{MD}$. In addition, since the point D of the bucket 13*c* rotates counterclockwise at the angular velocity $w_N$ around the bucket pin N, when a linear velocity at the point D of the bucket 13*c* relative to the bucket pin N is $\vec{v}_{D,N}$, $\vec{v}_{D,N}=\vec{w}_M\times\vec{L}_{ND}$.

Therefore, when a linear velocity at the point D of the bucket 13*c* is $\vec{v}_D$, $\vec{v}_D=\vec{v}_{D,M}+\vec{v}_{D,N}$. Here, since the point D of the bucket 13*c* moves toward the work area W, an expected collision distance $d_{go,D}$ is calculated to be finite, and the electronic control unit 500 determines that the point D of the bucket 13*c* is likely to invade the set work area W.

The electronic control unit 500 calculates the expected collision time $t_{go}$ for each of the point B of the arm 13*b* and the point C and the point D of the bucket 13*c* which are determined to have a possibility of invading the set work area W.

Specifically, the expected collision time of the point B of the arm 13*b* is $$t_{go,B}=\frac{d_{go,B}}{|\vec{v}_B|},$$

the expected collision time of the point C of bucket 13*c* is $$t_{go,C}=\frac{d_{go,C}}{|\vec{v}_C|},$$

and the expected collision time of the point D of the bucket 13*c* is $$t_{go,D}=\frac{d_{go,D}}{|\vec{v}_D|}.$$

The electronic control unit 500 compares a minimum value of the expected collision times $t_{go,B}$, $t_{go,C}$, and $t_{go,D}$ with a preset table to determine cutoff strength for at least one of an arm operation lever signal and a bucket operation lever signal.

According to the disclosure, even when the work device 13 is positioned close to the work area W, when the work device 13 is not likely to invade the work area W, a velocity of the work device 13 is not limited, and a worker's work connection becomes natural.

In addition, since cutoff strength for an operation signal of an operation lever 200 is determined according to a velocity at which the work device 13 approaches the work area W, even when an approach velocity of the work device 13 is fast, the work device 13 does not invade the work area W, and thus a worker can more stably operate the work device 13.

The terminology used herein is for the purpose of describing particular aspects only and is not intended to be limiting of the disclosure. As used herein, the singular forms "a" and "an" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the disclosure is not limited to the aspects described above and illustrated in the drawings; rather, the skilled person will recognize that many changes and modifications may be made within the scope of the disclosure and appended claims. In the drawings and specification, there have been disclosed aspects for purposes of illustration only and not for purposes of limitation, the scope of the disclosure being set forth in the following claims.

What is claimed is:

1. Construction equipment comprising:

a lower traveling part;

an upper turning part rotatably supported on the lower traveling part;

a work device which includes a boom, an arm, and a bucket operated by respective hydraulic cylinders and is supported on the upper turning part;

a control valve configured to control each of the hydraulic cylinders;

an operation lever configured to output an operation signal corresponding to an operation amount of a driver;

a work setting unit configured to set a work area of the work device;

an information providing unit configured to provide at least one of geographic information, position information of the work device, and posture information of the work device; and an electronic control unit configured to output a control signal for the control valve according to a signal input from at least one of the operation lever, the work setting unit, and the information providing unit, wherein, when the work device is likely to invade the work area, the electronic control unit determines cutoff strength for the operation signal based on a velocity of the work device wherein the cutoff strength increases as the velocity of the work device increases, wherein the electronic control unit calculates an expected collision distance ($d_{go}$) between one point of the work device and an expected collision point of the work area to determine whether the work device is likely to invade the work area, wherein, when the expected collision distance ($d_{go}$) is finite, the electronic control unit calculates an expected collision time ($t_{go}$) by dividing the expected collision distance ($d_{go}$) by a velocity of the one point of the work device, wherein the electronic control unit determines the cutoff strength for the operation signal based on the expected collision time ($t_{go}$) and a preset table, wherein the cutoff strength decreases as the expected collision time ($t_{go}$) increases.

2. The construction equipment of claim 1, wherein:

when the expected collision distance ($d_{go}$) is finite, the electronic control unit determines that the work device is likely to invade the work area; and when the expected collision distance ($d_{go}$) is infinite, the electronic control unit determines that the work device is not likely to invade the work area.

3. The construction equipment of claim 1, wherein, in the table:

when the expected collision time ($t_{go}$) is greater than or equal to a certain time, the cutoff strength for the operation signal is 0%;

when the expected collision time ($t_{go}$) is greater than or equal to 0 and less than or equal to the certain time, the cutoff strength for the operation signal increases as the expected collision time ($t_{go}$) decreases; and when the expected collision time ($t_{go}$) is 0, the cutoff strength for the operation signal is 100%.

4. The construction equipment of claim 3, wherein:

the work setting unit includes a display device configured to display an adjustment portion; and the electronic control unit includes a plurality of tables having different cutoff strengths for the operation signal and determines a standard table by adjusting the adjustment portion.

5. The construction equipment of claim 1, wherein the electronic control unit calculates the expected collision time ($t_{go}$) for each of a plurality of points of the work device and determines the cutoff strength for the operation signal based on a minimum value of the expected collision times ($t_{go}$) and the preset table.

6. The construction equipment of claim 1, wherein the information providing unit includes at least one of a position measurement unit configured to measure position information of the construction equipment, a posture measurement unit configured to measure posture information of the construction equipment and a posture of each work device, and a coordinate calculation unit configured to calculate coordinates based on information measured from the position measurement unit and the posture measurement unit.

7. The construction equipment of claim 1, wherein the operation lever is an electric joystick configured to generate an electrical signal in proportion to the operation amount of the driver and provide the electrical signal to the electronic control unit.

8. The construction equipment of claim 1, wherein the work setting unit has a function of setting a plurality of work modes according to needs of the driver and, according to a setting of the work mode, displays at least one of the geographic information, the position information of the work device, and the posture information of the work device, which are received from the information providing unit, on a display screen.

* * * * *